US007871334B2

(12) United States Patent
Young et al.

(10) Patent No.: US 7,871,334 B2
(45) **Date of Patent: *Jan. 18, 2011**

(54) GOLF CLUB HEAD AND GOLF CLUB WITH TENSION ELEMENT AND TENSIONING MEMBER

(75) Inventors: Matthew S. Young, Columbus, OH (US); Megan Sesslar Moore, Hilliard, OH (US); Mark J. Perry, Hilliard, OH (US); David M. Walters, Circleville, OH (US)

(73) Assignee: NIKE, Inc., Beaverton, OR (US)

( * ) Notice: Subject to any disclaimer, the term of this patent is extended or adjusted under 35 U.S.C. 154(b) by 75 days.

This patent is subject to a terminal disclaimer.

(21) Appl. No.: 12/205,301

(22) Filed: Sep. 5, 2008

(65) Prior Publication Data

US 2010/0062874 A1 Mar. 11, 2010

(51) Int. Cl.
*A63B 69/36* (2006.01)
*A63B 53/04* (2006.01)

(52) U.S. Cl. ..... 473/231; 473/242; 473/256; 473/329; 473/334; 473/342

(58) Field of Classification Search ..... 473/219–256, 473/324–350
See application file for complete search history.

(56) References Cited

U.S. PATENT DOCUMENTS

| | | | | |
|---|---|---|---|---|
| 890,836 | A * | 6/1908 | Beale | 473/329 |
| 1,558,703 | A | 10/1925 | Miller | |
| 2,175,598 | A * | 10/1939 | Fedak | 473/245 |
| 2,201,638 | A | 5/1940 | Theibault, Sr. | |
| 3,190,651 | A | 6/1965 | Thomas | |
| 3,516,674 | A | 6/1970 | Scarborough | |
| 3,893,670 | A | 7/1975 | Franchi | |
| 4,685,682 | A | 8/1987 | Isabell | |
| 5,011,153 | A * | 4/1991 | Watkins | 473/236 |
| 5,316,304 | A * | 5/1994 | Yost | 473/330 |
| 5,464,211 | A * | 11/1995 | Atkins, Sr. | 473/377 |
| 5,470,071 | A * | 11/1995 | Hsu et al. | 473/237 |
| 5,478,075 | A | 12/1995 | Saia et al. | |
| 5,501,453 | A * | 3/1996 | Hurst | 473/242 |
| 5,505,453 | A * | 4/1996 | Mack | 473/329 |
| 5,597,362 | A | 1/1997 | Lee et al. | |
| 5,632,693 | A | 5/1997 | Painter | |
| 5,643,109 | A * | 7/1997 | Rose et al. | 473/329 |

(Continued)

FOREIGN PATENT DOCUMENTS

EP 1257010 A2 11/2002

(Continued)

OTHER PUBLICATIONS

International Search Report and Written Opinion issued May 6, 2010 in corresponding PCT Application No. PCT/US2009/055845.

*Primary Examiner*—Sebastiano Passaniti
(74) *Attorney, Agent, or Firm*—Banner & Witcoff, Ltd.

(57) ABSTRACT

A golf club head includes a club head having a plurality of components and a plurality of retaining members, with each retaining member positioned on one of the components. A tensioning assembly for releasably securing the components of the club head together includes a tension element coupled to the club head components by way of the retaining members, and a tensioning member for introducing tension into the tension element.

27 Claims, 6 Drawing Sheets

U.S. PATENT DOCUMENTS

| | | | | |
|---|---|---|---|---|
| 5,899,819 | A | 5/1999 | Mount et al. | |
| 5,931,746 | A * | 8/1999 | Soong | 473/329 |
| 5,934,599 | A | 8/1999 | Hammerslag | |
| 6,202,953 | B1 | 3/2001 | Hammerslag | |
| 6,203,444 | B1 * | 3/2001 | McRae | 473/244 |
| 6,289,558 | B1 | 9/2001 | Hammerslag | |
| 6,361,451 | B1 | 3/2002 | Masters et al. | |
| 6,394,909 | B1 | 5/2002 | Laibangyang | |
| 6,461,250 | B1 | 10/2002 | Klyve | |
| 6,517,450 | B1 | 2/2003 | Klyve | |
| 6,524,197 | B2 * | 2/2003 | Boone | 473/324 |
| 6,672,975 | B1 | 1/2004 | Galloway | |
| 6,682,439 | B2 | 1/2004 | Brown | |
| 7,147,573 | B2 | 12/2006 | DiMarco | |
| 7,303,489 | B2 * | 12/2007 | Gilbert et al. | 473/350 |
| 2002/0128093 | A1 | 9/2002 | Whayne | |
| 2003/0017884 | A1 | 1/2003 | Masters et al. | |
| 2005/0054461 | A1 * | 3/2005 | Pakarnseree et al. | 473/329 |
| 2005/0075193 | A1 * | 4/2005 | Otoguro | 473/346 |
| 2006/0073908 | A1 | 4/2006 | Tavares et al. | |
| 2006/0178228 | A1 | 8/2006 | DiMarco | |
| 2008/0139335 | A1 * | 6/2008 | Tavares et al. | 473/332 |
| 2009/0170628 | A1 * | 7/2009 | Yoon | 473/333 |

FOREIGN PATENT DOCUMENTS

| | | | |
|---|---|---|---|
| WO | 9851375 | A2 | 11/1998 |

* cited by examiner

GOLF CLUB HEAD AND GOLF CLUB WITH TENSION ELEMENT AND TENSIONING MEMBER

FIELD OF THE INVENTION

Aspects of this invention relate generally to golf clubs and golf club heads, and, in particular, to golf clubs and golf club heads having a tension element and a tensioning member for securing body components together.

BACKGROUND

Golfers tend to be sensitive to the "feel" of a golf club. The "feel" of a golf club includes the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

The performance of a golf club can vary based on various factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively. Similarly, other factors such as point of impact and launch angle can also affect how the ball travels once it has been struck.

Accordingly, club heads may be formed with various configurations to provide different performance characteristics and "feels." For example, club heads can be configured to have different weights secured thereto to alter the performance characteristics and "feel" of the club. In other club heads, a component having a characteristic with a particular value, e.g., size or weight, can be replaced with another component having a different value for that characteristic. By varying the body components of a club head, its performance and "feel" can be altered.

It would be desirable to provide a golf club and golf club head that reduces or overcomes some or all of the difficulties inherent in prior known devices.

SUMMARY

The principles of the invention may be used to provide a golf club and golf club head with a tension element and tensioning member for securing club head components together. In accordance with a first aspect, a golf club head includes a club head having a plurality of components and a plurality of retaining members, with each retaining member positioned on one of the components. A tensioning assembly for releasably securing the components of the club head together includes a tension element coupled to the club head components by way of the retaining members, and a tensioning member for introducing tension into the tension element.

In accordance with another aspect, a golf club head includes a face plate including at least one face plate retaining member, a body member having at least one body retaining member; and a tensioning assembly having a tension element and a tensioning member connected to the tension element. The tension element engages the face plate and body member retaining members to releasably secure the face plate to the body member.

In accordance with a further aspect, a golf club assembly includes a shaft having a first end and a second end; and a club head secured to the first end of the shaft. The club head includes a plurality of components and a plurality of retaining members, each retaining member being positioned on one of the components. A tensioning assembly releasably secures the components of the club head together and includes a tension element slidably attached to at least some of the club head components by way of the retaining members, and a tensioning member for introducing tension into the tension element.

Substantial advantage is achieved by providing a golf club and golf club head with a tension element and tensioning member for securing club head components together. In particular, certain embodiments allow a user or other individual to quickly and reliably secure the components of a club head together, along with the ability to disassemble the club head at a later time to replace or change one or more components of the club head.

These and additional features and advantages disclosed here will be further understood from the following detailed disclosure of certain embodiments.

Figure 1:
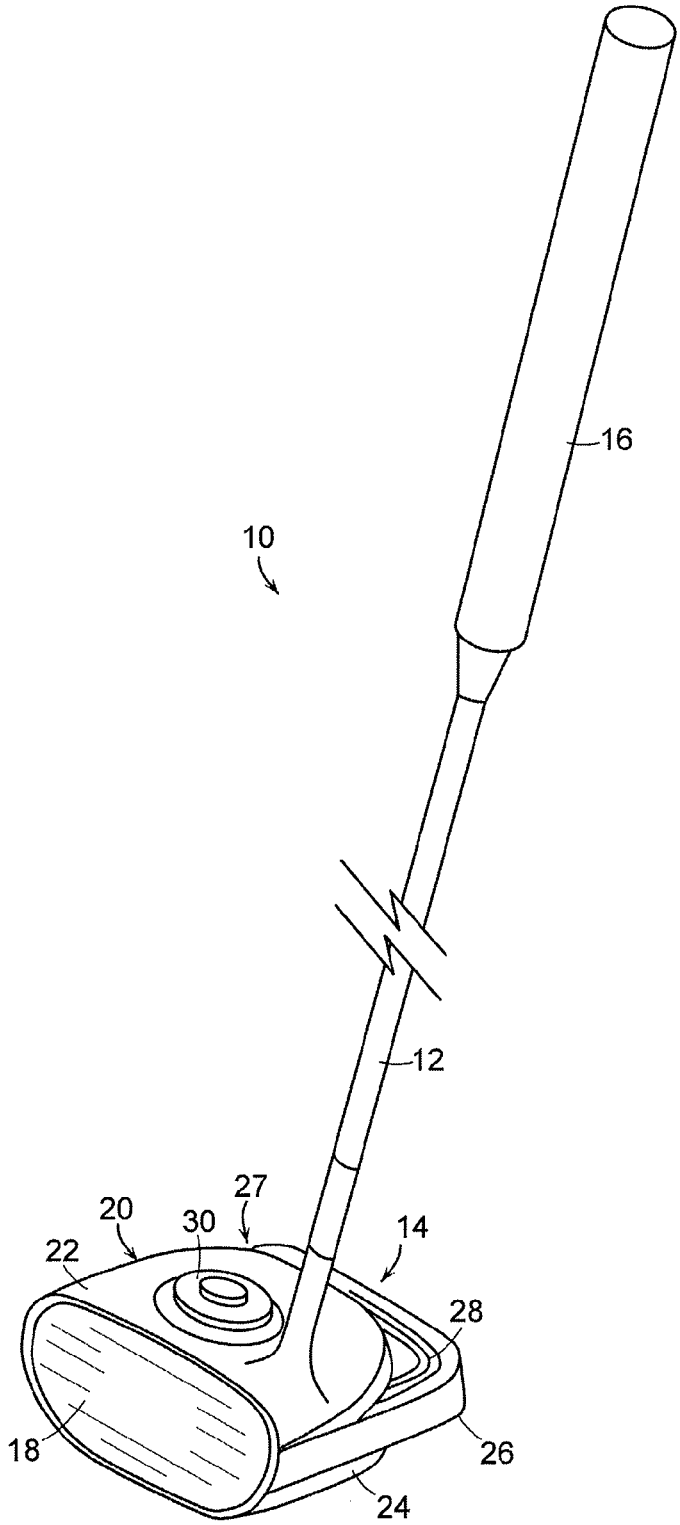
FIG. 1 is a perspective view of a golf club with a tension element and a tensioning member according to an illustrative aspect.

The figures referred to above are not drawn necessarily to scale, should be understood to provide a representation of particular illustrative embodiments of the invention, and are merely conceptual in nature and illustrative of the principles involved. Some features of the golf club and golf club head with a tension element and tensioning member for securing body components together depicted in the drawings have been enlarged or distorted relative to others to facilitate explanation and understanding. The same reference numbers are used in the drawings for similar or identical components and features shown in various alternative embodiments. Golf clubs and golf club heads with a tension element and tensioning member for securing body components together as disclosed herein would have configurations and components determined, in part, by the intended application and environment in which they are used.

DETAILED DESCRIPTION OF CERTAIN EMBODIMENTS

An illustrative embodiment of a golf club 10 is shown in FIG. 1 and includes a shaft 12 and a golf club head 14 attached to a first end of the shaft 12. Golf club head 14 may be any driver, wood, or the like. Shaft 12 of golf club 10 may be made of various materials, such as steel, aluminum, titanium, graphite, or composite materials, as well as alloys and/or combinations thereof, including materials that are conventionally known and used in the art. Additionally, the shaft 12 may be attached to the club head 14 in any desired manner, including in conventional manners known and used in the art (e.g., via adhesives or cements at a hosel element, via fusing techniques (e.g., welding, brazing, soldering, etc.), via threads or other mechanical connectors, via friction fits, via retaining element structures, etc.). A grip or other handle element 16 is positioned on shaft 12 to provide a golfer with a slip resistant surface with which to grasp golf club shaft 12. Grip element 16 may be attached to shaft 12 in any desired manner, including in conventional manners known and used in the art (e.g., via adhesives or cements, via threads or other mechanical connectors, via fusing techniques, via friction fits, via retaining element structures, etc.).

Club head 14 includes a plurality of components. As illustrated, this example golf club head 14 includes a face plate 18 and a body member 20 positioned behind face plate 18. In the illustrated embodiment, body member 20 includes a crown portion 22, a sole portion 24, and a skirt 26 positioned (e.g., extending) rearwardly from crown portion 22 and sole portion 24. It is to be appreciated that club head 14 may include any number of components.

Body member 20 of golf club head 14 may be constructed from a wide variety of different materials, including materials conventionally known and used in the art, such as steel, titanium, aluminum, magnesium, nickel, tungsten, alloys of these metals, graphite, polymers, fiber-reinforced materials, or composites, or combinations thereof. Other suitable materials will become readily apparent to those skilled in the art, given the benefit of this disclosure. It is to be appreciated that crown portion 22 and sole portion 24 may be formed of the same or different material.

The component elements of club head 14 are releasably secured to one another with a tensioning assembly 27 that includes a tension element 28 and a tensioning member 30. The use of tensioning assembly 27 allows a user or other individual to quickly and easily assemble the component parts of golf club head 14. Thus, for example, a user could be fitted in a shop for a golf club head that is optimized for their swing, and have that club assembled while in the shop. Once the user's swing has been evaluated and the desired components of the club head have been selected, the use of tensioning assembly 27 allows the components of club head 14 to be quickly assembled and releasably secured together.

Advantageously, the use of tensioning assembly 27 allows club head 14 to be disassembled at some future time, which allows for additional components to be added to club head 14, such as weights, for example, or for select components of club head 14 to be replaced with other components. Thus, it is possible to perform routine maintenance on a club head 14; as components of club head 14 experience fatigue or other performance degradation they can be quickly and easily replaced with other components.

Figure 2:
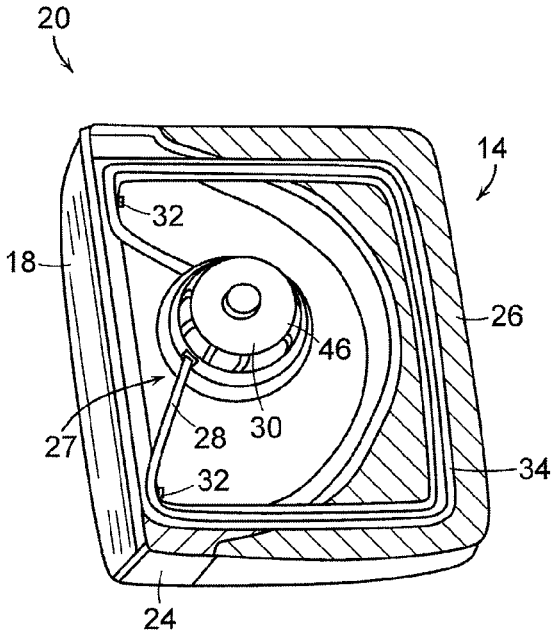
FIG. 2 is a section view of the club head of the golf club of FIG. 1.

As seen more clearly in FIG. 2, tension element 28 connects face plate 18 to body member 20. Tension element 28 has the ability to provide tension, which allows the components of club head 14 to be releasably and securely fastened to one another. Tension element 28 may take many forms including, but not limited to, a cable, cord, rope, wire, fiber, ribbon, chain, filament, and the like.

Figure 3:
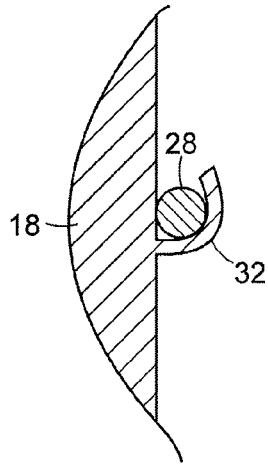
FIG. 3 is a section view of the face plate and tension element of the golf club of FIG. 1.

Tension element 28 engages (e.g., extends through, or is laced through) retaining members provided on the various components of club head 14. In the illustrated element, the face plate retaining members on face plate 18 are a pair of hooks 32, which are provided on a rear surface of face plate 18, as seen more clearly in FIG. 3. As illustrated here, hooks 32 are curved or arcuate members extending outwardly from the rear surface of face plate 18. Hooks 32 may be of unitary, that is, one-piece construction with face plate 18, or they may be separate elements secured to face plate 18 with any suitable fastening means such as welding, adhesive or the like.

It is to be appreciated that the retaining members need not be hooks, and can take any desired shape or form. For example, the retaining members could be L-shaped projections or J-shaped projections extending from face plate 18 or any other component of club head 14. The retaining members serve to slidably attach tension element 28 to club head 14. That is, the retaining members allow tension element 28 and the components of club head 14 to slide with respect to one another. At the same time the tension element 28 serves to releasably secure the components of club head 14 to one another.

Body member 20 may also include body retaining members to receive tension element 28. The body retaining members need not be the same shape as those found on face plate 18. A body retaining member provided on skirt 26 takes on another shape, namely a channel 34. Tension element 28 extends across sole portion 24 of body member 20 and then passes through channel 34 formed in an upper surface of skirt 26. Thus, it is to be appreciated that the retaining members that contact and retain tension element 28 with respect to the various components of club head 14 can take any desired shape or form that allows tension element 28 to connect and secure the various components of club head 14 to one another.

Figure 4:
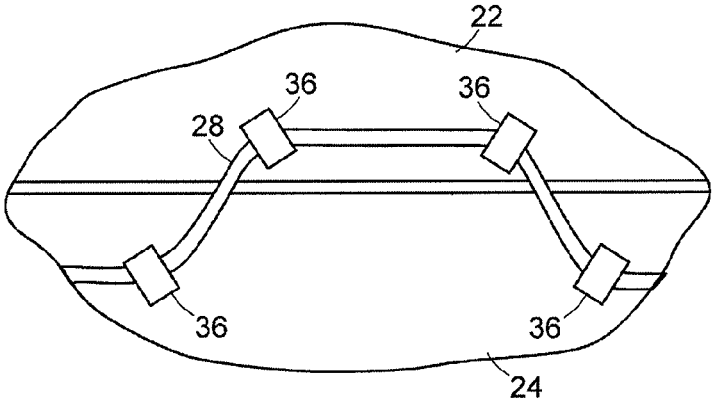
FIG. 4 is an elevation view of a portion of the body member of the club head of the golf club of FIG. 1.

In this illustrative embodiment, tension element is not directly connected to crown portion 22 or sole portion 24 of body member 20; crown portion 22 and sole portion 24 are sandwiched between face plate 18 and skirt 26. It is to be appreciated that in other embodiments, tension member may be in direct contact with crown portion 22 and sole portion 24. For example, as seen in FIG. 4, crown portion 22 and sole portion 24 of body member 20 may include retaining members such as hooks 36 or any other retaining member. Thus, it is to be appreciated that tension element 28 need not contact each and every element of club head 14 directly in order to releasably secure all of the components of club head 14 together.

Figure 5:
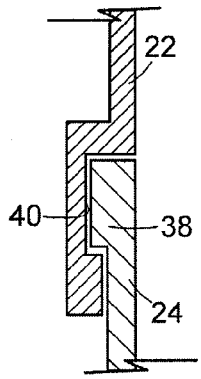
FIG. 5 is a section view of a portion of the body member of the club head of the golf club of FIG. 1.

In the embodiment illustrated in FIG. 2, tension element is not directly retained by any element on sole portion 24, as noted above. In such an embodiment, crown portion 22 and sole portion 24 are connected to one another as a unit, which unit is then sandwiched between face plate 18 and skirt 26. Sole portion 24 and crown portion 22 may be connected to one another in any desired manner. For example, as illustrated in FIG. 5, a projection 38 may be formed about a peripheral edge of sole portion 24, and a mating recess 40 may be formed in a peripheral edge of crown portion 22, with projection 38 being received in recess 40. Thus, sole portion 24 and crown portion 22 are releasably connected or secured to one another in interlocking fashion. It is to be appreciated that in other embodiments a projection could be formed about the peripheral edge of crown portion 22 with the mating recess being formed about the peripheral edge of sole portion 24.

Figure 6:
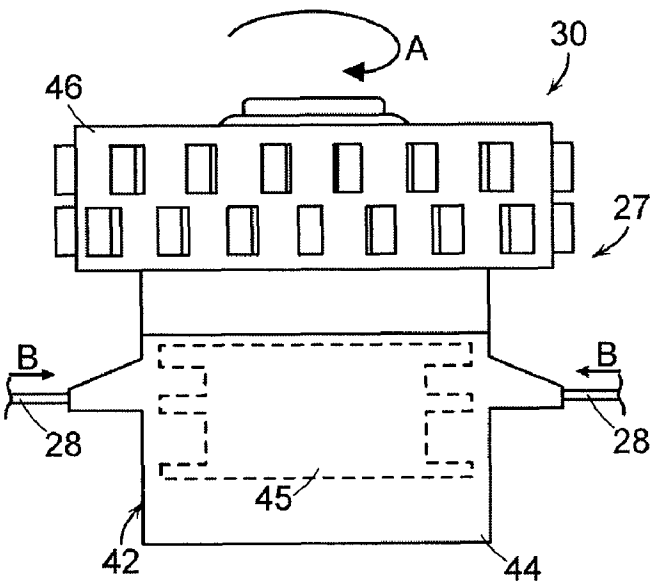
FIG. 6 is an elevation view of the tensioning member of the golf club of FIG. 1 in an engaged condition.

As noted above, tensioning member 30 serves to provide tension in tension element 28, thereby reliably and securely fastening the components of club head 14 to one another. In the illustrated embodiment, tensioning member 30, as seen in FIG. 6 in an engaged condition, is a ratcheting assembly 42 which operates in known fashion to tighten tension element 28, thereby firmly securing the components of club head 14 to one another.

Ratcheting assembly 42 includes a base portion 44 within which a spool 45 and ratcheting mechanism (not shown) is positioned. In the engaged condition of ratcheting assembly 42 shown in FIG. 6, the ends of tension element 28 are wrapped about spool 45 in known fashion as knob 46 is rotated by the user (clockwise in the direction of arrow A in the illustrated embodiment). As knob 46 rotates, the ends of tension element 28 move in the direction of arrows B into ratcheting assembly 42 and the opposed ends of tension element 28 are wound about spool 45, thereby shortening the portion of tension element 28 outside ratcheting assembly 42 and, consequently, increasing the tension in tension element 28 and securing the elements of club head 14 to one another.

Figure 7:
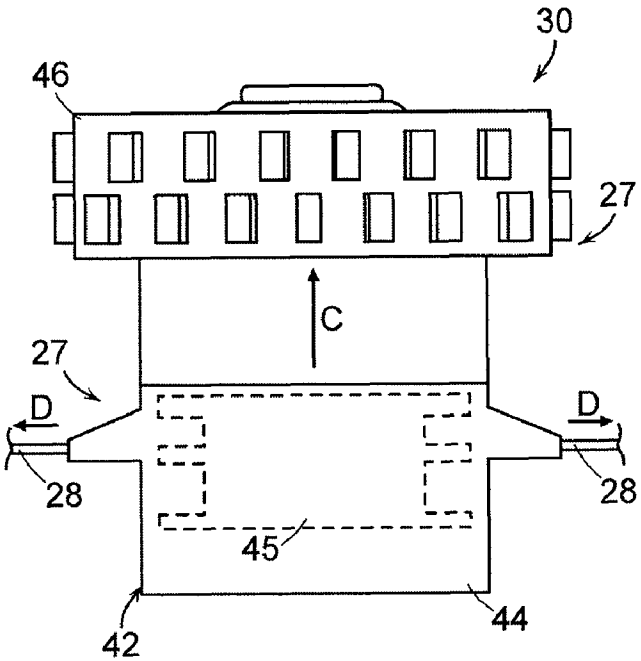
FIG. 7 is an elevation view of the tensioning member of the golf club of FIG. 1 in a disengaged condition.

To release the tension in ratcheting assembly 42, as illustrated in FIG. 7, knob 46 is lifted upwardly in the direction of arrow C to the disengaged condition, which releases the engagement of the ratcheting mechanism in ratcheting assembly 42, allowing the ends of tension element 28 to spin off of spool 45 and move outwardly from ratcheting assembly 42 in the direction of arrows D, thereby releasing the tension in tension element 28 and allowing club head 14 to be disassembled. A more detailed discussion of the internal operation of exemplary ratcheting assemblies is found in U.S. Pat. Nos. 5,934,599; 6,202,953; and 6,289,558, the entire disclosures of which are incorporated herein by reference in their entireties.

It is to be appreciated that in certain embodiments, tensioning element 30 is resistant to creep strain, thereby ensuring that the components of club head 14 remain securely attached to one another despite the rapid swinging of golf club 10 and repeated impacts of club head 14 with golf balls.

Figure 8:
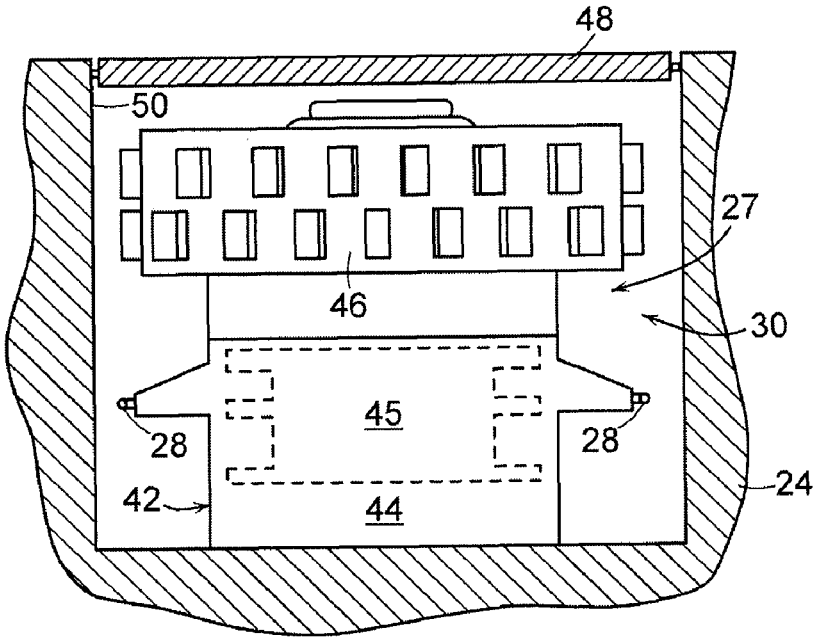
FIG. 8 is an elevation view of the tensioning member of the golf club of FIG. 1, shown within the body member of the club head and beneath a cover.

In certain embodiments, as illustrated in FIG. 1, tensioning member 30 is visible from the exterior of club head 14. In other embodiments, tensioning member 30 may be concealed within club head 14. For example, as illustrated in FIG. 8, a cover 48 is provided in an opening 50 formed in an upper surface of crown portion 24, thereby reducing the infiltration of dirt and debris into tensioning member 30. Cover 48 may be secured within opening 50 in known snap-fit fashion or the like. Either of cover 48 or opening 50 may have one or more tabs or other suitable projections that are received in corresponding slots or other suitable apertures in the other of cover 48 and opening 50 in order to secure cover 48 in its desired position. Other means of securing cover 48 will become readily apparent to those skilled in the art, given the benefit of this disclosure.

Figure 9:
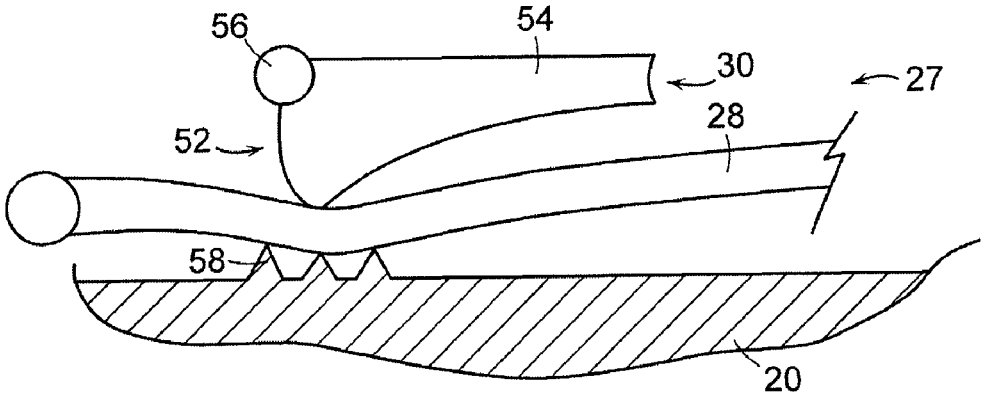
FIG. 9 is an elevation view of an alternative embodiment of a tensioning member shown in an engaged condition with a tension element.

It is to be appreciated that tensioning member 30 may take other forms in addition to the ratcheting assembly discussed above. For example, as seen in FIG. 9, tensioning member 30 may be a cam mechanism 52 including a cam lever 54 that pivots about a shaft 56, pinching tension elements 28 against a surface of body member 20. Body member 20 may include teeth 58 extending outwardly from its surface to help engage tension elements 28.

It is to be appreciated that any type of cam mechanism or any other tensioning member may be used that will provide tension to tension elements 28, thereby allowing the component parts of club head 14 to be firmly, reliably, and releasably secured to one another. Other suitable tensioning members will become readily apparent to those skilled in the art, given the benefit of this disclosure.

Figure 10:
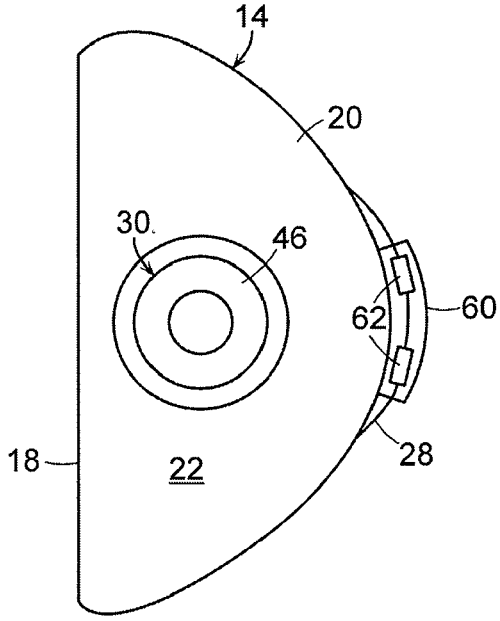
FIG. 10 is a plan view of another aspect of a golf club head shown with a weight attached thereto.

In certain embodiments, additional components can be added to club head 14. For example, as illustrated in FIG. 10, an additional weight 60 can be releasably secured to the other components of club head 14 by way of tension element 28. In the illustrated embodiment, club head 14 is shown without skirt 16 and with weight 60 positioned along the rear surface of body member 20, with tension element 28 engaged by retaining members 62 on weight 60. It is to be appreciated that weight 60 can be positioned at any location on club head 14, including being positioned within the interior of body member 20.

Figure 11:
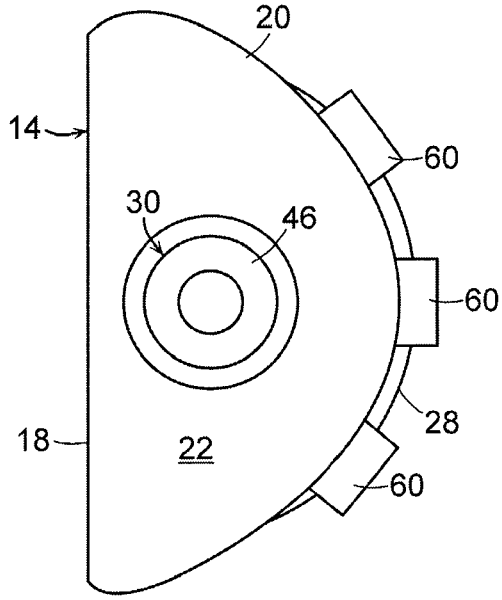
FIG. 11 is a plan view of another aspect of a golf club head shown with a plurality of weights attached thereto.

It is also to be appreciated that more than one weight 60 can be secured to club head 14. For example, as illustrated in FIG. 11, three weights 60 are positioned along the rear surface of club head 14. Any number of weights 60 can be included in club head 14, and each weight 60 can be positioned at any desired location within club head 14.

Since club head 14 can be quickly and easily assembled and disassembled through the use of tensioning assembly 27, the component parts of club head 14 can be quickly and easily interchanged or replaced with other components. Accordingly, a user can have a variety of different club head components that can be substituted for one another for a variety of reasons.

For example, a club component can be selected based on playing conditions expected to be encountered (e.g., different course conditions, different weather conditions, different wind conditions, etc.), the type of golf ball being used, and the skill or ability of the golfer. As a user improves, they may adapt a different playing style, and being able to replace the club head component allows them to modify their club without purchasing an entirely new club. It is to be appreciated that all aspects of the geometry or mass properties of club head 14 can be modified through the use of the interchangeable club head components including, but not limited to, the club head's shape, weight, weight distribution, bounce angle, center of gravity, moment of inertia, material of which it is formed, and appearance, which can alter the center of gravity, moment of inertia, and/or other "feel" characteristics of club head 14.

Figure 12:
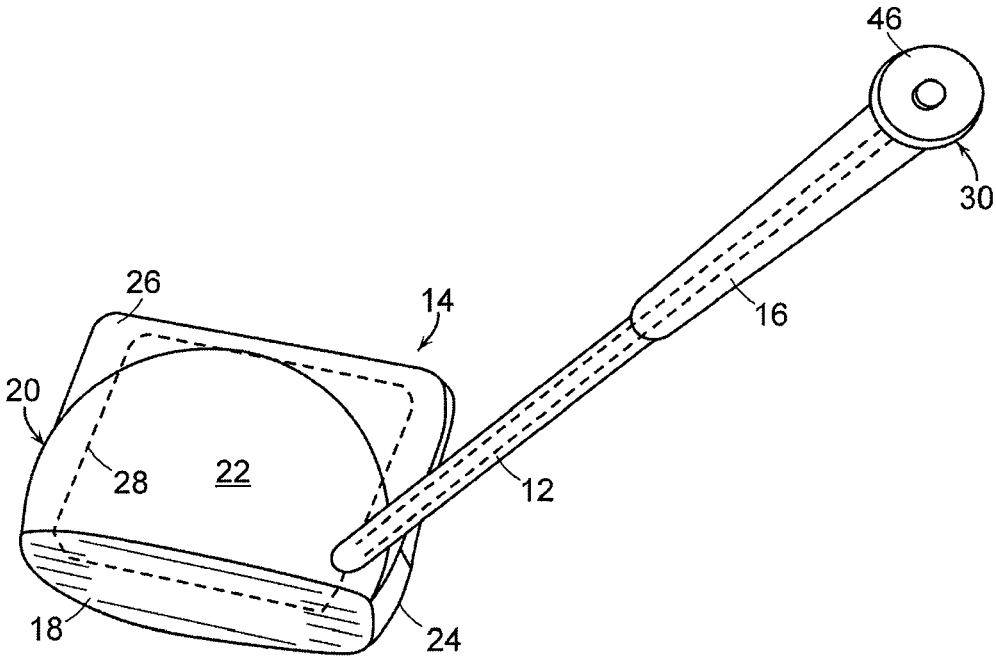
FIG. 12 is a perspective view of another aspect of a golf club with a tension element and a tensioning member located at an end of the shaft of the golf club remote from the club head.

As noted above, tensioning member 30 can be positioned at any location within golf club 10. In certain embodiments, as illustrated in FIG. 12, tensioning member 30 is positioned at a second end of shaft 12, remote from club head 14. In this embodiment, tension element 28 engages (e.g., is wound or laced through) the components of club head 14 and then extends upwardly through shaft 12 to tensioning member 30 at the end of shaft 12.

Figure 13:
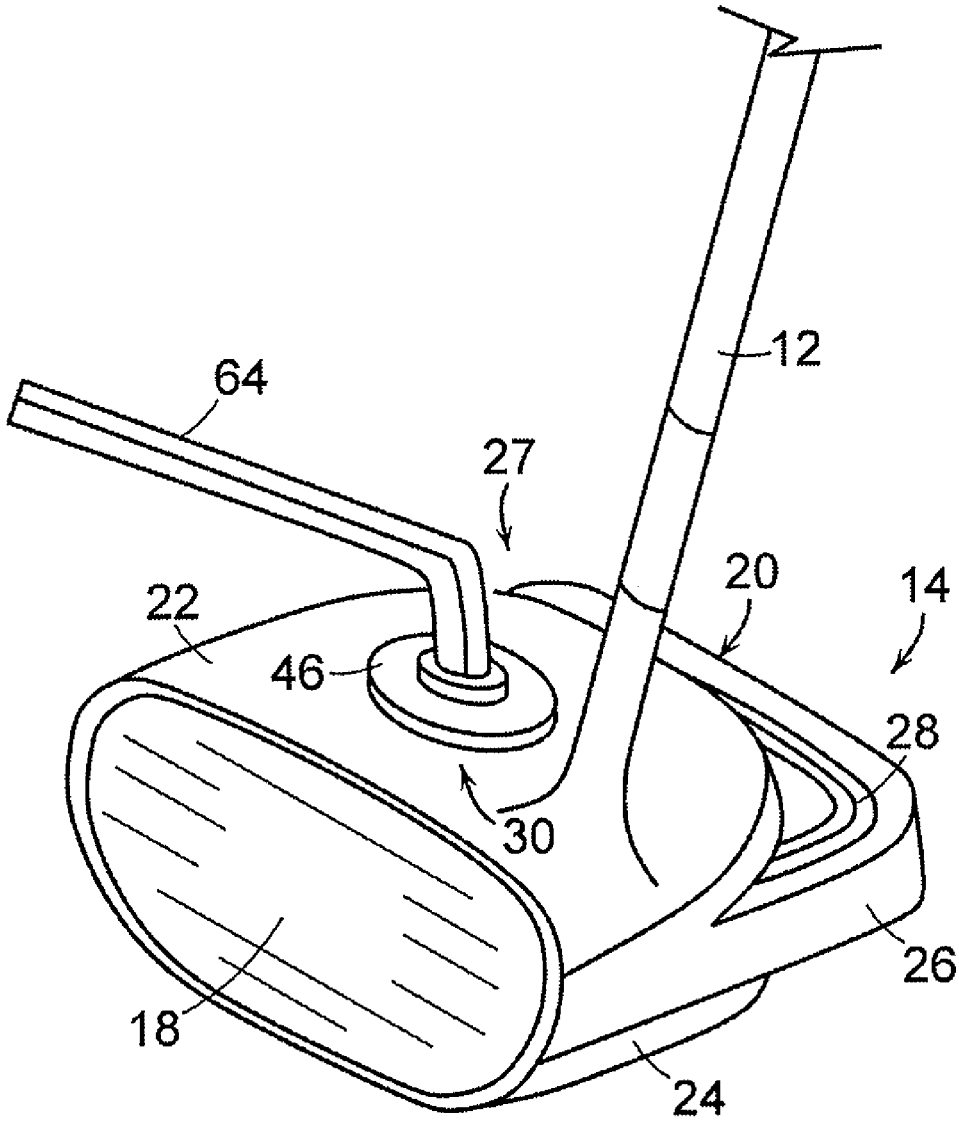
FIG. 13 is a perspective view of another aspect of a golf club with a tension element and a tensioning member, shown with a tool in use with the tensioning member.

Yet another embodiment is shown in FIG. 13, in which a tool 64 is used to facilitate turning of knob 46 of tensioning member 30. Tool 64, which may be a hex head wrench for example, provides additional leverage for turning knob 46, thereby increasing the ability of the user to provide a high level of tension in tension element 28. This can help ensure that the components of club head 14 are securely fastened together. In certain embodiments, tool 64 may be a torque wrench or other torque limiting tool that tensioning member 30 imparts the proper amount of tension to tension element 28.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head comprising:

a club head comprising a plurality of components including:

a face plate;

a body member positioned rearwardly of the face plate and having a crown portion, a sole portion positioned beneath the crown portion, a skirt positioned rearwardly of the crown portion and the sole portion, the crown portion and the sole portion being sandwiched between the skirt and the face plate, and a plurality of retaining members, each retaining member positioned on one of the components; and a tensioning assembly for releasably securing the components of the club head together and comprising:

a tension element slidably attached by way of the retaining members to the club head components, and a tensioning member for introducing tension into the tension element.

2. The golf club head of claim 1, wherein the skirt includes a channel through which the tension element extends.

3. The golf club head of claim 1, wherein the face plate includes a pair of retaining members on a rear surface thereof

4. The golf club head of claim 1, wherein at least a portion of the tensioning member is positioned in the body member.

5. The golf club head of claim 1, further comprising at least one weight releasably secured to the club head by the tensioning assembly.

6. The golf club head of claim 1, wherein the tensioning member includes a spool about which the tension element is wound.

7. The golf club head of claim 1, wherein the tensioning member includes a ratcheting assembly.

8. The golf club head of claim 1, wherein the tensioning member includes a cam mechanism.

9. The golf club head of claim 1, wherein the tension element is a cable.

10. The golf club head of claim 1, further comprising a tool for use with the tensioning member to increase tension in the tension element.

11. A golf club head comprising:

a face plate including at least one face plate retaining member;

a body member positioned rearwardly of the face plate, including a crown portion, a sole portion positioned beneath the crown portion, and a skirt extending rearwardly from the crown portion and the sole portion, the crown portion and the sole portion being sandwiched between the skirt and the face plate and having at least one body retaining member; and a tensioning assembly comprising a tension element and a tensioning member connected to the tension element, the tension element slidably attached by way of the retaining members to the face plate and body member to releasably secure the face plate to the body member.

12. The golf club head of claim 11, wherein the skirt includes a channel through which the tension element extends.

13. The golf club head of claim 11, further comprising at least one weight releasably secured to the club head by the tensioning assembly.

14. A golf club assembly comprising:

a shaft having a first end and a second end; and a club head secured to the first end of the shaft and comprising a plurality of components including:

a face plate;

a body member positioned rearwardly of the face plate, the body member including a crown portion, a sole portion positioned beneath the crown portion, and a skirt extending rearwardly from the crown portion and the sole portion, and a plurality of retaining members, each retaining member positioned on one of the components; and a tensioning assembly for releasably securing the components of the club head together and comprising:

a tension element slidably attached by way of the retaining members to the club head, and a tensioning member for introducing tension into the tension element.

15. The golf club assembly of claim 14, wherein the skirt includes a channel through which the tension element extends.

16. The golf club assembly of claim 14, wherein the crown portion and the sole portion are sandwiched between the skirt and the face plate.

17. The golf club assembly of claim 14, wherein the face plate includes a pair of retaining members on a rear surface thereof

18. The golf club assembly of claim 14, further comprising at least one weight releasably secured to the club head by the tensioning assembly.

19. The golf club assembly of claim 14, wherein the tensioning member includes a spool about which the tension element is wound.

20. The golf club assembly of claim 14, wherein the tensioning member includes a ratcheting assembly.

21. The golf club assembly of claim 14, wherein the tensioning member includes a cam mechanism.

22. The golf club assembly of claim 14, wherein the tension element is a cable.

23. The golf club assembly of claim 14, wherein at least a portion of the tensioning member is positioned in the club head.

24. The golf club assembly of claim 14, wherein the tensioning member is positioned at the second end of the shaft.

25. The golf club assembly of claim 14, further comprising a tool for use with the tensioning member to increase tension in the tension element.

26. A golf club assembly comprising:

a shaft having a first end and a second end;

a club head secured to the first end of the shaft and comprising:

a face plate including at least one face plate retaining member; and a body member positioned rearwardly of the face plate, including a crown portion, a sole portion positioned beneath the crown portion, and a skirt extending rearwardly from the crown portion and the sole portion, and having at least one body retaining member; and a tensioning assembly comprising a tension element and a tensioning member connected to the tension element, the tension element slidably attached by way of the retaining members to the face plate and body member to releasably secure the face plate to the body member.

27. The golf club head of claim 26, wherein the skirt includes a channel through which the tension element extends.

* * * * *

UNITED STATES PATENT AND TRADEMARK OFFICE

CERTIFICATE OF CORRECTION

PATENT NO. : 7,871,334 B2
APPLICATION NO. : 12/205301
DATED : January 18, 2011
INVENTOR(S) : Young et al.

It is certified that error appears in the above-identified patent and that said Letters Patent is hereby corrected as shown below:

Column 10, line 1 replace
"a body member positioned rearwardly of the face place,
including a crown portion,
a sole portion positioned beneath the crown portion, and a
skirt extending rearwardly from the crown portion and
the sole portion, and having at least one body retaining
member; and"

with

--a body member positioned rearwardly of the face plate, including a crown portion, a sole portion positioned beneath the crown portion, and a skirt extending rearwardly from the crown portion and the sole portion, and having at least one body retaining member; and--

Signed and Sealed this
Thirty-first Day of May, 2011

David J. Kappos

David J. Kappos
*Director of the United States Patent and Trademark Office*